US007754036B1

(12) United States Patent
Newman et al.

(10) Patent No.: US 7,754,036 B1
(45) Date of Patent: Jul. 13, 2010

(54) THERMOBARIC EXPLOSIVES AND COMPOSITIONS, AND ARTICLES OF MANUFACTURE AND METHODS REGARDING THE SAME

(75) Inventors: Kirk E. Newman, Yorktown, VA (US); Virgil Riffe, Gloucester, VA (US); Steven L. Jones, Toano, VA (US); Mark D. Lowell, Gloucester, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1216 days.

(21) Appl. No.: 10/729,264

(22) Filed: Dec. 3, 2003

(51) Int. Cl.
*C06B 33/08* (2006.01)
*C06B 25/34* (2006.01)

(52) U.S. Cl. ..... 149/38; 149/92

(58) Field of Classification Search ..... 149/92
See application file for complete search history.

(56) References Cited

U.S. PATENT DOCUMENTS

| | | | | |
|---|---|---|---|---|
| 2,836,484 A | | 5/1958 | Streng et al. | |
| 3,138,501 A | * | 6/1964 | Wright | 149/92 |
| 3,373,062 A | * | 3/1968 | Morris | 149/6 |
| 3,377,955 A | * | 4/1968 | Hodgson | 102/289 |
| 3,617,405 A | | 11/1971 | Stevenson | 149/39 |
| 3,658,607 A | | 4/1972 | Cook et al. | 149/2 |
| 3,886,010 A | | 5/1975 | Thornley et al. | 149/60 |
| 4,115,167 A | | 9/1978 | Sbrocca | 149/19.5 |
| 4,130,061 A | | 12/1978 | Boggs et al. | 102/66 |
| 4,372,213 A | | 2/1983 | Rozner et al. | 102/301 |
| 4,376,083 A | | 3/1983 | Ulsteen | 264/3 |
| 4,566,919 A | | 1/1986 | Jessop | 149/20 |
| 4,764,316 A | * | 8/1988 | Brown et al. | 264/3.1 |
| 5,472,531 A | | 12/1995 | Turci et al. | 149/92 |
| 5,565,150 A | | 10/1996 | Dillehay et al. | 264/3.3 |
| 5,672,843 A | | 9/1997 | Evans et al. | 102/289 |
| 5,834,680 A | | 11/1998 | Nielson et al. | 102/336 |
| 5,945,627 A | | 8/1999 | Arpin et al. | 102/202.11 |
| 6,113,713 A | | 9/2000 | Blomquist | 149/45 |
| 6,241,281 B1 | | 6/2001 | Hinshaw et al. | 208/741 |
| 6,312,625 B1 | | 11/2001 | Nielson et al. | 264/3.3 |
| 6,432,231 B1 | | 8/2002 | Nielson et al. | 149/19.3 |
| 6,523,477 B1 | | 2/2003 | Brooks et al. | 102/481 |

FOREIGN PATENT DOCUMENTS

EP 0959057 A1 * 11/1999

* cited by examiner

*Primary Examiner*—Aileen Felton
(74) *Attorney, Agent, or Firm*—Fredric Zimmerman

(57) ABSTRACT

A pressable explosive composition is provided. The composition includes at least 40 weight percent of substantially uncoated fuel particles, a nitramine mechanically blended with the substantially uncoated fuel particles, and a binder coating the nitramine. The binder constitutes about 1 to about 6 weight percent of the pressable explosive composition. Also provided are a pressed thermobaric explosive, weapons containing the pressed thermobaric explosive, and methods for making the composition and thermobaric explosive.

34 Claims, 2 Drawing Sheets

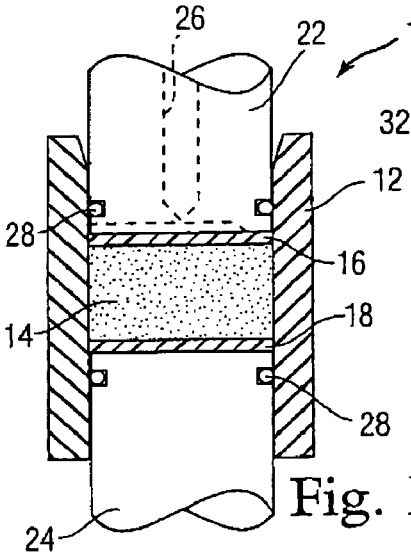
Fig. 1A
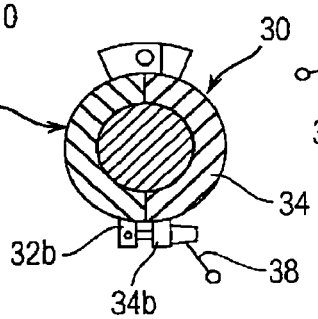
Fig. 2A
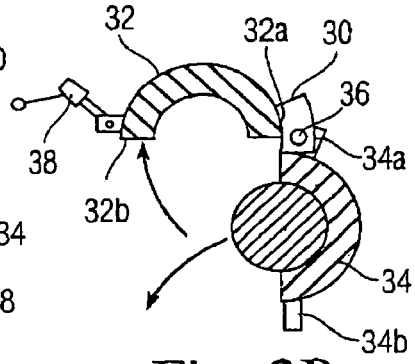
Fig. 2B
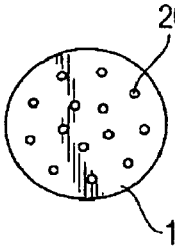
Fig. 1B
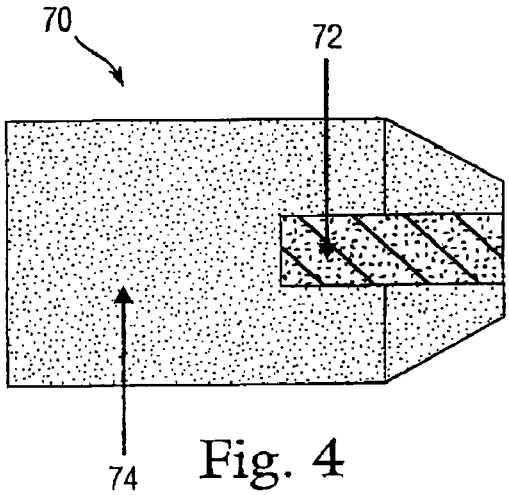
Fig. 4
Fig. 3
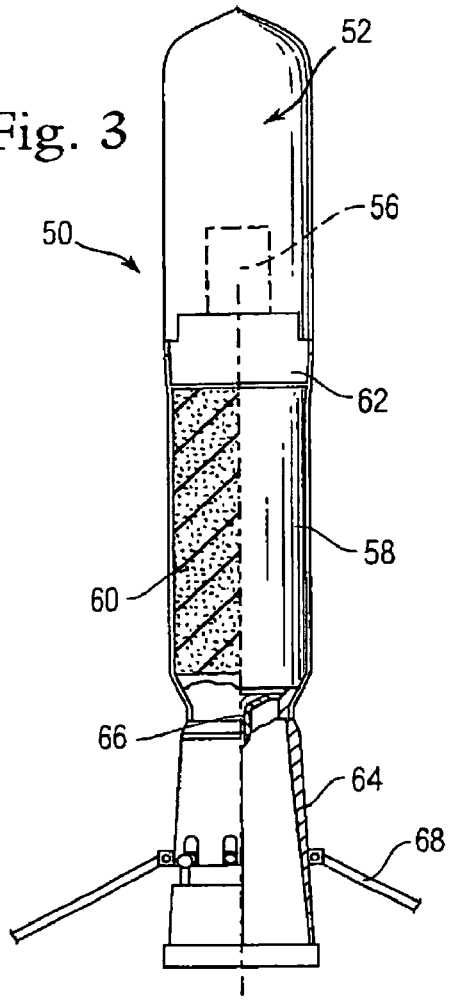

THERMOBARIC EXPLOSIVES AND COMPOSITIONS, AND ARTICLES OF MANUFACTURE AND METHODS REGARDING THE SAME

STATEMENT REGARDING FEDERALLY SPONSORED RESEARCH OR DEVELOPMENT

The invention described herein may be manufactured and used by or for the Government of the United States of America for governmental purposes without the payment of any royalties thereon or therefore.

BACKGROUND OF THE INVENTION

1. Field of the Invention

This invention relates to the field of explosive compositions, especially compositions useful for thermobaric weapons, and further relates to thermobaric weapons and methods for making and employing the same.

2. Description of the Related Art

Standard-type explosives selected for fragmentation and/or penetration effects constitute one of the most commonly used categories of conventional explosives. Such standard explosives typically comprise a relatively high density, oxygen-balanced composition. An example of a weapon containing such standard explosives is the shoulder-launched rocket, which is useful, for example, in repelling and destroying armored vehicles and the like. The shaped charge of the shoulder-launched rockets creates a high velocity metal jet that inflicts damage over a relatively narrow radius. As a result, conventional fragmentation/penetration weapons are primarily useful against confined and discrete targets located directly along the travel path of the weapon. Standard explosives are less effective against expansive targets, such as multi-room buildings, and hidden or entrenched targets (e.g., field fortifications, machine gun posts, and the like) that are not in a direct path or cannot be reached by a direct path of penetration.

Volumetric explosives constitute another explosive weaponry category, and are designed to overcome shortcomings of standard explosives. Volumetric explosives are generally characterized by their superb incendiary and blast effects. For example, some volumetric explosives, are capable of creating large fireballs upon detonation. Fuel-air explosives (FAEs) fall within this category. Generally, FAEs are aerobic fuel-rich gels or slurries and are aerobic, i.e., compositions containing a fuel component that combusts with oxygen in the surrounding atmosphere upon detonation. FAE weapons generally contain a "burster" that, upon detonation, disperses the fuel component outward as an aerosol and then either detonates or ignites to promote the aerobic reaction of the fuel component with the oxygen in air. The relatively low-order burning event generated by the burster limits the extent of damage imparted by the FAE. For example, the FAE usually have limited success in reaching deeply burrowed targets.

A class of explosives known as thermobaric explosives (TBX) also falls within the volumetric weaponry category. Thermobaric explosives are designed to produce heat and pressure effects instead of armor piercing or fragmentation damage effects. Thermobaric explosives are generally fuel-rich compositions containing a nitramine, characterized by the energy release occurring over a longer period of time than standard explosives, thereby creating a long-duration pressure pulse. Without wishing to be bound by a particular theory, it is believed that the thermobaric explosive undergoes the following stages upon detonation. In a first stage, an initial shock (or blast) wave from the explosive causes the nitramine to undergo anaerobic detonation in an essentially reduction-oxidization (redox) reaction occurring within hundreds of microseconds to disperse the fuel particles. In a second stage, the anaerobic combustion of fuel particles occurs within hundreds of microseconds. The anaerobic combustion process occurs along the detonation shock wave and consumes fuel particles in close proximity to the detonating nitramine. In the third stage, the fuel-rich energetic material is subject to aerobic combustion, which results from the shock wave mixing with oxygen in the surrounding air and has a duration of, for example, several microseconds. Residual nitramine is preferably present in the shock wave and undergoes anaerobic reaction with the fuel particles to propagate the shock wave and increase dispersion of the fuel particles.

Thermobaric explosives typically are plastic bonded explosive (PBX) compositions, which typically comprise a metallic fuel and an oxidizer or nitramine. One drawback associated with the use of a PBX composition in a thermobaric weapon is that the metallic fuel sometimes does not combust completely. Due to the diminished return of increasing fuel content, the fuel content is regulated so as to not exceed 35 weight percent, and more typically falls within a range of 20 to 35 weight percent. Due to this low fuel content, most successful traditional thermobaric weapons have been designed relatively large in size to furnish adequate fuel. Weight and size penalties accompany the large size and weight of such weapons. Although decreasing the size of the weapon can overcome this drawback, smaller thermobaric weapons tend to generate insufficient overpressure to kill targets "in the open."

Without wishing to be bound by any theory, it is also believed by the present inventors that TBX compositions generally act like "high" or "underwater" explosives and, as such, are characterized by shock-propagated reactions. Shock propagated reactions can bounce off of walls and succumb to rarefaction in closed spaces. Although shock wave rarefaction enables a high degree of mixing and multiple reactions, it also can limit the effective range of the thermobaric explosive, especially in closed or labyrinth-like spaces such as caves or multi-room buildings.

3. Objects of the Invention

It is one object of this invention to provide a pressable explosive composition especially suited for use in thermobaric weapons.

It is another object of the invention to provide a pressed thermobaric explosive, especially one capable of penetrating deeply into complex and entrenched structures, such as caves and multi-room buildings.

It is a further object of the invention to provide a pressed thermobaric explosive less prone to adverse performance caused by rarefaction in enclosed spaces.

It is another object of the invention to provide a pressed thermobaric explosive having improved sensitivity characteristics, including electrostatic and frictional sensitivities.

It is another object of this invention to provide articles of manufacture, such as but not necessarily limited to warheads, projectiles, grenades and munitions comprising the pressed thermobaric explosive of this invention.

It is yet another object of this invention to provide methods for making the pressable explosive compositions, thermobaric explosives, and articles of manufacture of the present invention.

SUMMARY OF THE INVENTION

To achieve the foregoing objects, and in accordance with the purposes of the invention as embodied and broadly described in this document, according to a first aspect of this invention there is provided a pressable explosive composition. The composition comprises substantially uncoated fuel particles constituting at least 40 weight percent of the pressable explosive composition, a nitramine mechanically blended with the substantially uncoated fuel particles, and a binder coating the nitramine. The binder preferably yet optionally constitutes about 1 to about 6 weight percent of the pressable explosive composition.

According to a second aspect of the invention, a pressed thermobaric explosive is provided. The explosive comprises free fuel particles constituting at least 40 weight percent of the pressed thermobaric explosive, a nitramine mechanically blended with the free fuel particles, and a binder coating the nitramine. The binder preferably yet optionally constitutes about 1 to about 6 weight percent, of the pressed thermobaric explosive. The pressed thermobaric explosive preferably possesses at least one, and still more preferably all, of the following characteristics: (a) an equal or lesser electrostatic discharge sensitivity than RDX; (b) a frictional sensitivity less than 235 psig, more preferably less than 420 psig, as measured by an ABL sliding friction test; (c) a frictional sensitivity less than 360 N, more preferably less than 252 N, as measured by the BAM sliding friction test; and (d) a compressive strength greater than 42,000 psi, more preferably greater than 45,000 or 50,000 psi.

A third aspect of the invention comprises an article of manufacture comprising the pressed thermobaric explosive of the second aspect of the invention. Representative articles include rocket-propelled grenades and manually propelled grenades.

According to a fourth aspect of the invention, a method is provided for making an explosive composition. The method comprises coating a nitramine with a binder, and mechanically mixing the coated nitramine with substantially uncoated fuel particles to provide a pressable explosive composition comprising at least 40 weight percent of the substantially uncoated fuel particles, and preferably about 1 to about 6 weight percent of the binder. The explosive composition is preferably yet optionally consolidated via pressing to provide a pressed thermobaric explosive.

Another aspect of the invention involves a method for pressing a thermobaric explosive into a shaped object. According to this aspect, the method comprises providing a mold apparatus comprising a die having an inner surface defining side walls of a cavity, first and second rams movable relative to one another for defining opposite walls of the cavity, respectively, and first and second capture members. A sample of pressable explosive composition is situated in the cavity of the mold apparatus, with the first capture member positioned between the first ram and the sample, and the second capture member positioned between the second ram and the sample. At least one, and optionally both, of the rams are moved towards one another to press the explosive composition into a pressed thermobaric explosive. The side walls are preferably coated with a mold release compound (e.g., zinc stearate). It is also preferred to place the peripheries of the capture member in continuous contact with the side walls, to provide a mild scraping action, and optionally to provide a clearance between outer surfaces of the first and second rams and the side walls. The fine particle size fuel particles (e.g., metal powder) tend to flow between the rams and die during consolidation, increasing friction to such an extent that the pressed charge may not slide out of the die. The preferred yet optional use capture discs to prevent said flow greatly reduces this friction to manageable levels, facilitating extraction of the charge by pushing the charge out of the die with one of the rams. The material for the capture disks should be lubricious, to allow a tight fit with the die and good capture of fine particles, while being able to slide with a minimum of friction. In addition, the capture disk material should have sufficient mechanical strength to resist deformation during pressing without being hard enough to gall the die. In practice, molybdenum-disulphide filled nylon 6/6, commonly known as MDS nylon or Nylatron (trade mark), provides the proper balance of lubricity and mechanical properties.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings:

FIG. 1A is a schematic side view, partially in cross section, of an assembly for pressing an explosive composition;

FIG. 1B is an overhead view of a top capture disc of the assembly of FIG. 1A;

FIGS. 2A and 2B are overhead sectional views of a pressing assembly die body of another embodiment of the invention in closed and open positions, respectively;

FIG. 3 is a schematic side view of a rocket-propelled warhead according to an embodiment of the invention;

FIG. 4 is a sectional side view of a manual propelled grenade according to another embodiment of the invention;

Figure 5:
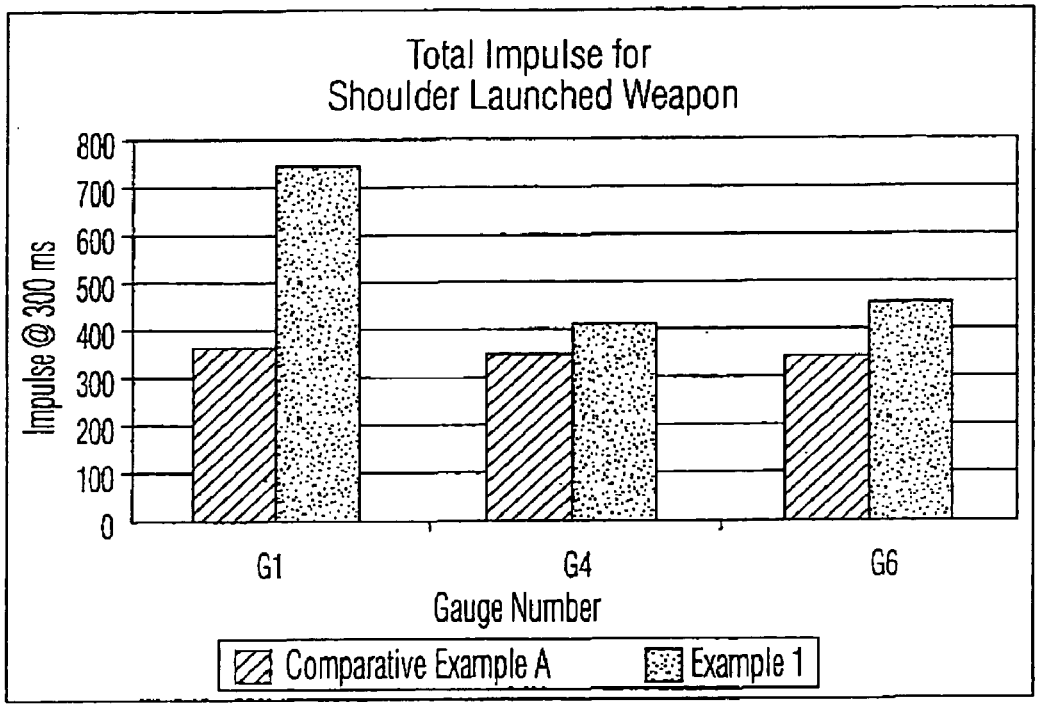
FIG. 5 is a bar graph comparing the total impulse (psig*sec@300 milliseconds (m·s)) of the billets of Example 1 to Comparative Example A.

DETAILED DESCRIPTION OF CERTAIN PREFERRED EMBODIMENTS AND METHODS OF THE INVENTION

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

According to a preferred embodiment of the invention, the pressable explosive composition comprises at least 40 weight percent of substantially uncoated fuel particles, a nitramine mechanically blended with the substantially uncoated fuel particles, and about 1 to about 6 weight percent binder coating the nitramine. The uncoated fuel particles and the coated nitramine are preferably blended substantially homogeneously.

The substantially uncoated fuel particles preferably yet optionally possess one or more of the following properties: a high heat of combustion, relatively low melting point, high surface area (small particle size), and flammability. If the fuel particles are solid, the particles are preferably dry in processing and in the pressable explosive composition to maximize reactivity with air. The fuel particles are preferably yet optionally selected from aluminum, magnesium, magnalium, and combinations thereof. Of these, aluminum and magnalium are particularly preferred. Magnalium is an alloy of magnesium and aluminum, usually but not necessarily in a 1:1 molar ratio. Another example of a fuel particle that may be practiced with embodiments of the invention is carbon powder, especially carbon powder containing at least 4 weight percent volatiles. Examples of carbon powder include, not necessarily by limitation, bituminous coal and/or petroleum coke.

In embodiments of the invention the pressable explosive composition possesses a stoichiometric excess of fuel particles. The stoichiometric excess of the fuel particles may be, for example, about 2:1 to about 4:1 molar ratio of fuel to oxidizer. Although the molecular weights of the fuel and oxidizer (e.g., nitramine) may affect the weight ratio, the free particles preferably constitute about 50 to about 70 weight percent of the total composition weight, or in certain embodiments about 60 to about 70 weight percent of the total composition weight. The maximum content of the fuel particles may be increased, although further increases may depend theoretically, if not practically, on the detonability and processibility of the composition.

The uncoated fuel particles may have an average particle diameter, for example, in a range from about 0.1 micron to about 25 microns, more preferably about 1 micron to about 5 microns. Generally, particles sizes below this range, such as "nanoparticles," have high weight ratios of oxide surface layers. Larger particle sizes have lower surface area ratios and may compromise performance. In an optional embodiment, the fuel particles may consist of particles having dimensions in these ranges.

The oxidizer of the thermobaric composition comprises, and may optionally consist of, one or more nitramines. The selected nitramine preferably has one or more of the following properties: a high heat of combustion, a high detonation pressure, and a high detonation velocity. Representative nitramines useful in the thermobaric explosive composition of embodiments of the invention include, for example, 1,3,5-trinitro-1,3,5-triazacyclohexane (RDX), 1,3,5,7-tetranitro-1,3,5,7,-tetraazacyclooctane (HMX), and 2,4,6,8,10,12-hexanitro-2,4,6,8,10,12-hexaazatetracyclo-[5.5.0.0$^{5,9}$0$^{3,11}$]-dodecane (CL-20 or HNIW). Of these, RDX and HMX are especially preferred for use alone or in combination.

The nitramine is preferably present in particulate form. The nitramine particles are preferably spherical, but may take other forms, such as granules, prills, flakes, etc. The nitramine particles may be present in a mono-modal or multi-modal distribution. Mono-modal distributions may have an average particle size of, for example, about 5 microns. An exemplary bi-modal distribution consists of about 70 weight percent coarse particles having an average particle size of about 200 microns, and about 30 weight percent fine particles having an average particle size of about 5 microns.

A portion, but preferably no more than about 50 weight percent, and optionally no more than 30 weight percent, of the nitramine is replaceable with an ionic salt oxidizer. Examples of such oxidizers include nitrates and perchlorates, including ammonium nitrate, ammonium perchlorate, potassium nitrate, potassium perchlorate, sodium nitrate, and sodium perchlorate. Another oxidizer that may replace a portion or all of the nitramine are fluorocarbons, such as polytetrafluoroethylene. According to a preferred embodiment, the substantially uncoated fuel particles, the nitramine, and the ionic salt oxidizer constitute from about 92 weight percent to about 99 weight percent of the pressable explosive composition.

Representative binders that may be used with various embodiments include, for example, thermoplastic polymers, such as polyacrylates (e.g., HyTemp®), fluoroelastomers (e.g., Viton®), thermoplastic polyesters (e.g., Estane®), polyoxetanes, poly-α-olefins, and waxes, especially petroleum-based waxes (e.g., paraffin waxes, microcrystalline waxes).

The pressable explosive composition may optionally include additional components, such as a plasticizer. An exemplary plasticizer used in the following examples is dioctyl adipate, although it should be understood that other plasticizers may be selected.

A method for making a pressable explosive composition according to an embodiment of the invention will be described below. The described method is exemplary; however, the pressable explosive compositions of this invention are not necessarily limited to explosives made by this exemplary method.

According to an embodiment of the invention, the pressable explosive composition is prepared as follows. A slurry is prepared by dispersing a binder in a solvent. Representative solvents that may be used in embodiments of the inventive method include, for example, ethyl acetate or methyl ethyl ketone, to provide a lacquer. The nitramine particles and optionally additional oxidizers, preferably in a dry state, are then introduced into a mixer containing water to create a suspension. The mixer may be a baffled mixer agitating the water at a sufficiently high rate to generate vertical vortices. As the oxidizer is suspended, the lacquer is metered into the suspension at a rate to precipitate the binder onto the oxidizer (nitramine) as a coating. Precipitation of the binder onto the nitramine particles may be facilitated by practicing one, and more preferably all, of the following parameters: a water-to-solvent weight ratio ($\alpha$) of about 9:1 to about 10:1; a water-to-nitramine weight ratio ($\beta$) of about 3:1 to about 4:1; and a solvent-to-binder weight ratio ($\gamma$) of about 19:1 to about 22:1. The solvent is then removed from the coated particles by any suitable method, such as distillation (e.g., at about 80° C.) to provide suspended, coated particles in a water phase. The water may then be decanted and filtered, followed by heat treatment (e.g., 40° C. to 60° C.) to provide dry coated oxidizer particles having a moisture content of preferably less than 0.05 weight percent. Uncoated fuel particles, preferably in a dry state, are mechanically blended with the dry coated oxidizer particles, preferably under substantially dry, substantially solvent-free conditions. Mixing is preferably continued in any suitable dry blending apparatus (e.g., wye blenders and conical mixers) until homogeneity is reached.

A method for processing a pressable explosive composition into a pressed thermobaric explosive according to an embodiment of the invention will be described below. The described method is exemplary; however, the pressed thermobaric explosives of this invention are not necessarily limited to explosives made by this exemplary method.

According to an embodiment of the invention, the pressable explosive composition is consolidated in pressing assembly 10. As shown in FIG. 1A, the pressing assembly 10 includes an annular die 12 shown in cross section. The annular die 12 may be made of metal, such as steel. Situated within annular die 12 is a sample 14 of the pressable explosive composition interposed between upper capture disc 16 and lower capture disc 18. As shown in FIG. 1B, the upper capture disc 16 has breather holes 20. Although not shown, the lower capture disc 18 may optionally exclude breather holes. The capture discs 16 and 18 are sized to fit snugly into the annular die 12, preferably having a diameter 0 to 0.0005 inch larger than the inner diameter of the annular die 12. This close fit produces a mild scraping action that limits the flow of fine particles of the composition, i.e., sample charge 14, past the edges of the capture discs, 16 and 18, during consolidation. The capture discs may be made of, for example, nylon filled with 15 weight percent molybdenum disulfide, such as available as Nylatron®. An upper press ram 22 is situated above the upper capture disc 16, and a lower eject ram 24 is situated below the lower capture disc 18. A mechanical gap of approximately 0.001 to approximately 0.003 inch is optionally present between the inner diameter of the annular die 12 and the outer diameters of the rams 22 and 24 (when the rams 22 and 24 and the die 12 are concentrically positioned). The upper press ram 22 includes a vacuum path 26 shown in dashed lines. The vacuum path 26 has a longitudinal portion concentric with the upper press ram 22 and branched portions extending from the longitudinal portion to breather holes 20. O-rings 28 are provided around the circumference of the rams 22 and 24, respectively.

In operation, the inner surface of the annular die 12 may be treated with a heavy grease, such as a silicone grease or red chassis grease to increase lubricity and fill any microstructural clearances or gaps in the die 12. Grease may also serve to reduce reaction between oxygen and the reactive aluminum surfaces of the free fuel particles. The lower capture disc 18 is seated on the lower eject ram 24, and the lower capture disc 18 and the lower eject ram 24 are inserted into the bottom of the annular die 12. The sample charge 14 is loaded into the top end of the annular die 12 and seated on the lower capture disc 18. The upper capture disc 16 is then inserted into the top end of the annular die 12, followed by the upper press ram 22. The first and second rams 22 and 24 are moved relative to one another to press the sample charge 14. This relative movement may comprise movement of either one of the first and second rams 22 and 24, or movement of both of the rams 22 and 24. The vacuum removes any air present between the capture discs 16 and 18. The scraping action of the capture discs 16 and 18 as the rams 22 and 24 advance prevents particles of the sample charge 14 from filling the annular clearances between the rams and die 12, which in turn prevents the rams from jamming in the die 12. After consolidation, either the upper ram 22 or the lower ram 24 is retracted, and the opposing ram is used to push the pressed charge 14 and capture discs 16 and 18 out of the die 12.

An alternative embodiment of a pressing assembly annular die is illustrated in FIGS. 2A and 2B and generally designated by reference numeral 30. The annular die assembly 30 comprises body members 32 and 34. In the illustrated embodiment, the body members 32 and 34 each extend over a 180-degree semi-circular arc to collectively define the side wall of a cylindrical cavity. The body members 32 and 34 include first flanges 32*a* and 34*a*, respectively, and second flanges 32*b* and 34*b*, respectively. The first flanges 32*a*, 34*a* are generally diametrically opposed to the second flanges 32*b*, 34*b*. The first flanges 32*a* and 34*a* are pivotally connected about pin 36. A locking bolt 38 is pivotally connected to the second flange 32*b* of body member 32, and is engageable with a recess in the second flange 34*b* of the body member 34. Body member 32 is pivotal about the pin 36 between a closed position (FIG. 2A) and an open position (FIG. 2B). In the closed position, the locking bolt 38 is actuatable for locking the body members 32 and 34 in the closed position. In operation, the body members 32 and 34 are placed and locked in their closed position, and a sample of pressable explosive composition is loaded into the cavity and pressed with opposing rams (not shown in FIGS. 2A and 2B). After the explosive composition has been consolidated/pressed, the locking bolt 38 is unlocked and the body member 32 is moved into its open position, facilitating removal of the pressed object (e.g., pellet, billet) from the die 30. The pressed object does not have to slide along the inside of the die 30, reducing the tendency of the press rams to jam.

Magnalium is generally more difficult to consolidate than aluminum in the pressing step. Accordingly, a portion (e.g., 50 weight percent) of the magnalium is preferably preconditioned with a wax composition for improving its cast consolidation capabilities. According to a preferred embodiment, a portion of the uncoated magnalium fuel particles is treated with Comp-D-2 wax (Military specification MIL-C-18164), which comprises 84 weight percent wax (Military specification MIL-W-20533), 14 weight percent nitrocellulose (Military specification MIL-N-244), and 2 weight percent lecithin (Military specification MIL-L-3061). The Comp D-2 wax is then melted and mixed with about 73 weight percent magnalium and about 3.5 weight percent wood rosin (Federal specification, LLL-R-626). The preconditioned magnalium particles may be cast into sheets by pouring onto aluminum trays. The thickness of the resultant preconditioned magnalium sheet is about ¼-inch. Once the sheet is cool, it is broken into chips. Then the cooled chips are ground into a powder using a blender (for small scale) or a commutating machine (for large scale) so that a free flowing powder is obtained, having an average particle size of about 500-microns. Then the preconditioned magnalium powder is combined with unconditioned magnalium powder in a weight ratio of, for example, about 50:50.

As described above, the fuel particles in the pressable explosive composition are substantially uncoated. As referred to herein, pressable means unconsolidated or partially, but not completely, consolidated. As also referred to herein, the term "substantially uncoated" does not necessarily exclude the presence of an oxygen or oxygen-containing layer, such as a passivation layer (e.g., metallic oxide, such as aluminum oxide), covering the surfaces of the fuel particles. The term substantially uncoated also does not preclude contact between the binder and the fuel particle surfaces. Rather, the term substantially uncoated is meant to differentiate fuel particles of the pressable explosive composition of the present invention from a traditional cast and pressed plastic-bonded explosive (PBX). A cast PBX is prepared by mixing an oxidizer (e.g., a nitramine) and fuel in a liquid thermosetting polymer binder system, such as a lacquer. Upon cure, the binder encapsulates and holds the oxidizer and fuel particles, alone or collectively in clusters, in a relatively tight cross-linked matrix. Similarly, a traditional pressed PBX is prepared by solvating a thermoplastic binder in a slurry mixer to provide a lacquer, and blending the fuel and oxidizer particles in the lacquer. The solvent is stripped off by vacuum, causing the thermoplastic to precipitate onto and encapsulate the nitramine and fuel particles in a tightly held matrix. In contrast, although the substantially uncoated particles of the present invention are mechanically mixed with binder-coated oxidizer (e.g., nitramine), the binder of the oxidizer does not encapsulate and tightly hold the fuel particles as a continuous coating.

As also described above, the fuel particles in the pressed thermobaric explosive characterized as "free fuel particles." As referred to herein, the term "free" denotes that the fuel particles of the pressed thermobaric explosive are derived from a substantially uncoated state prior to consolidation/pressing of the explosive composition. (Consolidation of the pressable explosive composition may cause the binder of the binder-coated oxidizer to surround and encapsulate the fuel particles; however, the binder holds the free fuel particles more loosely than coated fuel particles of a conventional PBX.) Without wishing to be bound by any theory, it is believed that the relative freedom of the fuel particles of the pressed thermobaric explosive is at least partially responsible for improved properties of the pressed thermobaric explosive compared to those of a conventional cast or pressed PBX having binder-coated fuel particles.

In embodiments of the invention, improved properties of the pressed thermobaric explosive of the present invention may reside in one or more of the following. The pressed thermobaric explosive preferably has an electrostatic discharge (ESD) sensitivity (Joules) less than that of RDX, that is, less than 0.165 J. The pressed thermobaric explosive also preferably has a frictional sensitivity of less than 420 psig, more preferably less than 235 psig for an ABL friction test, and/or a frictional sensitivity of less than 252, more preferably less than 180 for the BAM friction test. All sensitivity tests mentioned herein are measured by standard MIL-STD-1751A, "Safety and Performance Tests for the Qualification of Explosives." The pressed thermobaric explosive preferably has an improved compressive strength of greater than 42,000 psi, more preferably greater than 45,000 psi, and still more preferably 50,000 psi, as measured by ASTM D695. All ESD and friction sensitivity data are based on a threshold initiation limit (TIL) of 20.

The thermobaric explosives of the present invention may serve as part of an article of manufacture, such as a weapon or projectile. For example, FIG. 3 illustrates a projectile, such as a shoulder-launched projectile, generally designated by reference numeral 50. The projectile 50 comprises a warhead casing 52 loaded with a thermobaric explosive, a fuse 56, a motor case 58 loaded with a propellant charge 60, an end closure 62 for attaching the motor case 58 to the warhead case 52, and an aft nozzle assembly 64 (the left side shown in section) comprising an igniter 66 and a plurality of fins 68. Embodiments of the thermobaric explosive of the present invention may be loaded in the warhead casing 52. According to another embodiment of the invention, the thermobaric explosive may form the explosive charge of a hand grenade 70, such as shown in FIG. 4. The hand grenade comprises a booster 72 and explosive charge 74.

Without wishing to be bound by any theory, it is believe that the performance of the pressed thermobaric explosives of embodiments of the present invention may be optimized if initiated by shock, but propagated as a thermobaric reaction, generally involving an anaerobic reaction between the oxidizer and fuel. Preferably, the oxidizer content is limited to that necessary to propagate the thermobaric reaction. The excess fuel is carried by the blast waves and acts as an oxygen chaser, reacting aerobically with oxygen in the surrounding environment. The aerobic reaction permits for higher loadings of fuel and reduced loadings of oxidizer in the composition, thereby increasing the overall energy output. Additionally, the excess fuel acts as an "oxygen chaser" and, as such, the aerobic burn of the excess fuel is less limited by the geometry of the target than a conventional plastic bound explosive.

The thermobaric explosives of embodiments of the present invention may have one or more of the following advantages compared to conventional plastic bonded explosives: a higher density, permitting a higher explosive weight to be delivered to the target; a higher heat of combustion, permitting the delivery of more heat to a target; a higher flame temperature, permitting the generation of higher temperatures at the target; and higher fuel content, allowing the reaction to last for a longer duration.

EXAMPLES

The following examples serve to explain and elucidate the principles and practice of the present invention further. These examples are merely illustrative, and not comprehensive or exhaustive of the many types of embodiments of the present invention that can be prepared in accordance with embodiments of the present invention.

Example 1

TABLE 1

| Ingredient | Weight Percent |
|---|---|
| Aluminum (5 micron) | 50.0 |
| HMX | 46.0 |
| Polyacrylate elastomer | 1.0 |
| Dioctyl adipate | 3.0 |

The HMX in each of the examples and the comparative example was a 55/45 blend of HMX Class 1 (about 250 microns) and Class 5 (about 8 microns).

A coated binder comprising the HMX, polyacrylate elastomer, and dioctyl adipate was prepared via the following slurry process. A lacquer was prepared by dissolving the polyacrylate elastomer in an organic solvent, such as ethyl acetate or methyl ethyl ketone. The dioctyl adipate plasticizer was then dissolved in the polyacrylate elastomer slurry. The resulting slurry was then slowly metered into a vessel containing the HMX suspended in water by high-speed agitation. Metering was conducted at a rate sufficient to allow the organic phase to remain fluidized. Precipitation of plasticized polyacrylate elastomer onto the HMX particles was observed. After all of the slurry had been metered into the vessel, the temperature in the vessel was then elevated to strip off the solvent and cause continued precipitation of the plasticized polyacrylate elastomer onto the HMX particles. The removed solvent was distilled and recovered for recyling. Water remaining with the coated HMX particles was filtered to provide a wet molding powder, which was spread onto trays and dried in an oven until the moisture was not more than 0.05 weight percent.

The dried, coated HMX particles were then blended with the 5-micron aluminum powder in a rotating conical mixer or wye blender. The blended molding powder was consolidated in an apparatus similar to that shown in FIG. 3 between Nylatron capture discs to provide a billet. FIG. 5 is a bar graph comparing the total impulse (psig*sec@300 m·s) of the billets of Example 1 to a Comparative Example A.

Example 2

TABLE 2

| Ingredient | Weight Percent |
|---|---|
| (a) Magnalium (1:1 Mg/Al, 15 microns) | 35.0 |
| (b) Filler M | 35.0 |
| (i) Magnalium (1:1) | 73.0 wt % |
| (ii) Comp D2 wax | 23.5 wt % |
| (iii) Wood Rosin | 3.5 wt % |
| (c) PBX | 30.0 |
| (i) HMX | 96.0 wt % |
| (ii) Polyacrylate elastomer | 1.0 wt % |
| (iii) Dioctyl adipate | 3.0 wt % |

Filler M was prepared by sequentially adding the melt composition D2 (MIL-C-18164) and the wood rosin (Federal Specification LLL-R-626) to vessel while agitating thoroughly. Magnalium powder (in 1:1 ratio of Mg/Al, 15 micron particle size) was added to the vessel in two or three increments. The second (and optional third) increments were added only after the first (and second) increments had been thoroughly incorporated into the mixture. Agitation was ceased upon reaching homogeneity, and the mixture was cast in a thin layer onto trays and cooled. The cooled layer was broken up into chips, then ground into powder to provide Filler M.

Figure 6:
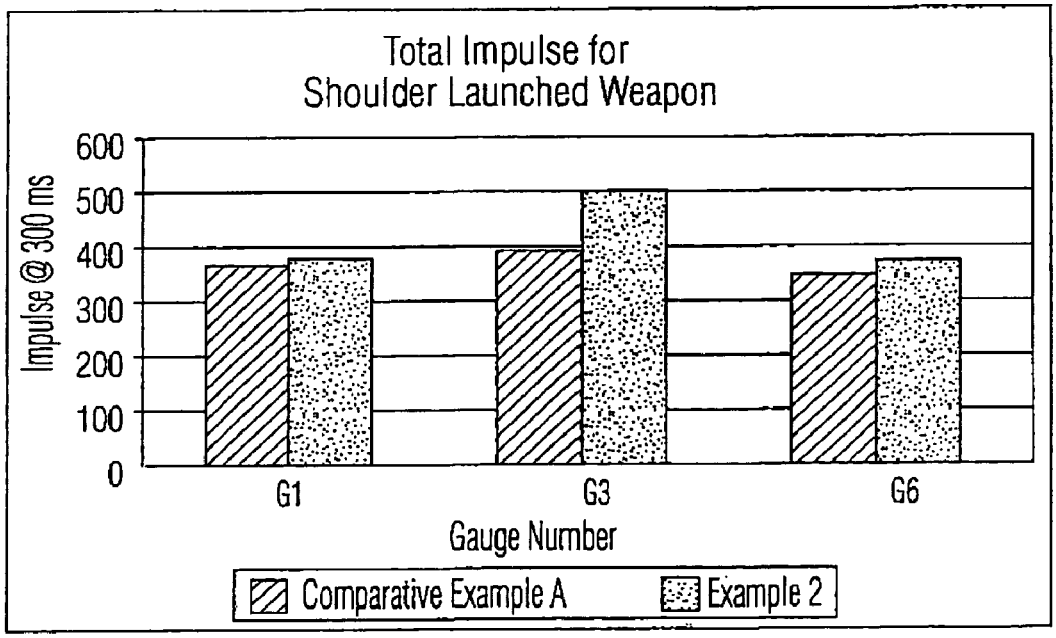
FIG. 6 is a bar graph comparing the total impulse (psig*sec@300 milliseconds (m·s)) of the billets of Example 2 to Comparative Example A.

PBX was prepared in the same manner described above in Example 1 with respect to coating of the HMX particles. The magnalium powder (15 microns) was then blended with the PBX and Filler M in a rotating conical mixer (or wye blender). The blended molding powder was consolidated in an apparatus similar to that shown in FIG. 3 between Nylatron capture discs to provide a billet. FIG. 6 is a bar graph comparing the total impulse (psig*sec@300 m·s) of the billets of Example 2 to Comparative Example A Comparative Example A Comparative Example A comprises a castable composition. This composition comprises a thermosetting polyurethane containing a weight ratio of HMX to Al of 45:35. The nominal formulation is set forth below in Table 3:

TABLE 3

| Ingredient | Weight Percent |
|---|---|
| Hydroxy-Terminated Polybutadiene (HTPB) | 9.335 |
| Isodecyl Pelargonate (IDP) | 9.335 |
| Lecithin (L) | 0.36 |
| Ethanox-702 antioxidant (AO) | 0.05 |
| Triphenyl Bismuth (TPB) | 0.03 |
| Isophorone diisocyanate (IPDI) | 0.89 |
| Aluminum (Al) | 35.00 |
| HMX | 45.00 |

Comparative Example A was prepared in a jacketed vertical planetary mixer operated at low speed under vacuum throughout the process. The binder components HTPB, IDP, L, AO, and TPB were added to the mixer. The Al was added in two equal portions sequentially. The HMX was then added in two equal portions sequentially. The IPDI was finally added and mixing continued. The mixed composition is then vacuum castable into a mold or weapon, and heat curable.

A comparison of Examples 1 and 2 against Comparative Example A demonstrates that the inventive compositions exceed the performance of conventional thermobaric explosives, in some cases by as much as 30% of the total impulse result (psig*sec@300 ms).

The foregoing detailed description of the certain preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A pressable explosive composition, comprising:

substantially uncoated fuel particles constituting at least 40 weight percent of total composition weight of the pressable explosive composition;

a nitramine being mechanically blended with the substantially uncoated fuel particles; and a binder coating the nitramine forming a binder coated nitramine, wherein said substantially uncoated fuel particles are non-encapsulated substantially uncoated fuel particles in contact with said binder coated nitramine.

2. A pressable explosive composition according to claim 1, wherein the binder constitutes about 1 to about 6 weight percent of the pressable explosive composition.

3. A pressable explosive composition according to claim 1, wherein the substantially uncoated fuel particles are selected from the group consisting of aluminum, magnesium, magnalium, and combinations thereof.

4. A pressable explosive composition according to claim 1, wherein the substantially uncoated fuel particles constitute about 50 to about 70 weight percent of the pressable explosive composition.

5. A pressable explosive composition according to claim 1, wherein the substantially uncoated fuel particles constitute about 60 to about 70 weight percent of the pressable explosive composition.

6. A pressable explosive composition according to claim 1, wherein the substantially uncoated fuel particles include an average particle diameter of about 1 micron to about 5 microns.

7. A pressable explosive composition according to claim 1, wherein the nitramine comprises a member selected from HMX and RDX.

8. A pressable explosive composition according to claim 1, further comprising an ionic salt oxidizer coated with the binder.

9. A pressable explosive composition according to claim 7, wherein the substantially uncoated fuel particles, the nitramine, and the ionic salt oxidizer collectively constitute from about 92 weight percent to about 99 weight percent of the pressable explosive composition.

10. A pressed thermobaric explosive, comprising:

free fuel particles constituting at least 40 weight percent of total composition weight of the pressed thermobaric explosive;

a nitramine being mechanically blended with the free fuel particles; and a binder coating the nitramine forming a binder coated nitramine, wherein said free fuel particles are non-encapsulated free fuel particles in contact with said binder coated nitramine.

11. A pressed thermobaric explosive according to claim 10, wherein the binder constitutes about 1 to about 6 weight percent of the pressed thermobaric explosive.

12. A pressed thermobaric explosive according to claim 10, wherein the free fuel particles are selected from at least one of aluminum, magnesium, and magnalium.

13. A pressed thermobaric explosive according to claim 10, wherein the free fuel particles constitute about 50 to about 70 weight percent of the pressed thermobaric explosive.

14. A pressed thermobaric explosive according to claim 10, wherein the free fuel particles constitute about 60 to about 70 weight percent of the pressed thermobaric explosive.

15. A pressed thermobaric explosive according to claim 10, wherein the free fuel particles include an average particle diameter of about 1 micron to about 5 microns.

16. A pressed thermobaric explosive according to claim 10, further comprising an ionic salt oxidizer being coated with the binder.

17. A pressed thermobaric explosive according to claim 16, wherein the free fuel particles, the nitramine, and the ionic salt oxidizer constitute from about 92 weight percent to about 99 weight percent of the pressed thermobaric explosive.

18. A pressed thermobaric explosive according to claim 10, wherein the pressed thermobaric explosive includes an electrostatic discharge sensitivity no greater than an electrostatic discharge sensitivity of RDX.

19. A pressed thermobaric explosive according to claim 10, wherein the pressed thermobaric explosive includes a frictional sensitivity less than 235 psig as measured by an ABL sliding friction test.

20. A pressed thermobaric explosive according to claim 10, wherein the pressed thermobaric explosive includes a frictional sensitivity less than 420 psig as measured by an ABL sliding friction test.

21. A pressed thermobaric explosive according to claim 10, wherein the pressed thermobaric explosive includes a compressive strength greater than 42,000 psi.

22. A pressed thermobaric explosive according to claim 10, wherein the pressed thermobaric explosive includes a compressive strength greater than 45,000 psi.

23. A pressed thermobaric explosive according to claim 10, wherein the pressed thermobaric explosive includes a compressive strength greater than 50,000 psi.

24. An article of manufacture, comprising:

a pressed thermobaric explosive, the pressed thermobaric explosive comprises at least 40 weight percent of free fuel particles of total composition weight of the article;

a nitramine being mechanically blended with the free fuel particles; and a binder coating the nitramine forming a binder coated nitramine, wherein said free fuel particles are non-encapsulated free fuel particles in contact with said binder coated nitramine.

25. An article of manufacture according to claim 24, wherein the binder comprises about 1 to about 6 weight percent of the pressed thermobaric explosive.

26. An article of manufacture according to claim 24, wherein the article comprises a projectile comprising a warhead including the pressed thermobaric explosive, a motor comprising a case and a propellant housed in the case, and a nozzle assembly associated with the motor for generating thrust and propelling the warhead.

27. An article of manufacture according to claim 24, wherein the article comprises a hand grenade.

28. An article of manufacture according to claim 24, wherein the free fuel particles are selected from at least one of aluminum, magnesium, and magnalium.

29. An article of manufacture according to claim 28, wherein the free fuel particles constitute about 50 to about 70 weight percent of the pressed thermobaric explosive.

30. An article of manufacture according to claim 28, wherein the free fuel particles constitute about 60 to about 70 weight percent of the pressed thermobaric explosive.

31. An article of manufacture according to claim 28, wherein the free fuel particles include an average particle diameter of about 1 micron to about 5 microns.

32. An article of manufacture according to claim 28, further comprising an ionic salt oxidizer.

33. An article of manufacture according to claim 32, wherein the free fuel particles, the nitramine, and the ionic salt oxidizer comprise from about 92 weight percent to about 99 weight percent of the pressed thermobaric explosive.

34. A pressed thermobaric explosive, comprising:

free fuel particles;

a nitramine being mechanically blended with the free fuel particles; and a binder coating the nitramine forming a binder coated nitramine, wherein said free fuel particles are at least 40 total weight percent of total composition weight of said pressed thermobaric explosive, and wherein said free fuel particles are non-encapsulated free fuel particles in contact with said binder coated nitramine.

* * * * *